US009774132B2

(12) United States Patent
Lindkamp et al.

(10) Patent No.: US 9,774,132 B2
(45) Date of Patent: Sep. 26, 2017

(54) CABLE OUTLET WITH CURABLE POLYMER

(71) Applicant: HARTING ELECTRONICS GMBH, Espelkamp (DE)

(72) Inventors: Marc Lindkamp, Luebbecke (DE); Ralf Martin Klein, Laatzen (DE)

(73) Assignee: HARTING ELECTRONICS GMBH (DE)

( * ) Notice: Subject to any disclaimer, the term of this patent is extended or adjusted under 35 U.S.C. 154(b) by 0 days.

(21) Appl. No.: 15/116,795

(22) PCT Filed: Apr. 8, 2015

(86) PCT No.: PCT/DE2015/100146

§ 371 (c)(1),
(2) Date: Aug. 4, 2016

(87) PCT Pub. No.: WO2015/158327

PCT Pub. Date: Oct. 22, 2015

(65) Prior Publication Data

US 2017/0025788 A1 Jan. 26, 2017

(30) Foreign Application Priority Data

Apr. 16, 2014 (DE) ..... 10 2014 105 442

(51) Int. Cl.
*H01R 4/64* (2006.01)
*H01R 13/56* (2006.01)
(Continued)

(52) U.S. Cl.
CPC ..... *H01R 13/562* (2013.01); *H01R 13/5205* (2013.01); *H01R 13/5216* (2013.01); *H01R 43/005* (2013.01)

(58) Field of Classification Search
CPC ..... H01R 13/5216
(Continued)

(56) References Cited

U.S. PATENT DOCUMENTS 2,932,585 A * 4/1960 Hubbell ..... C23D 3/00 427/374.2
3,555,171 A * 1/1971 Larson ..... H02G 15/013 174/138 F
(Continued)

FOREIGN PATENT DOCUMENTS

DE 202004018347 1/2005 ..... H02G 3/22
DE 102012202225 8/2013 ..... F16J 15/10
EP 0859429 8/1998 ..... H01R 13/52

OTHER PUBLICATIONS

International Search Report (w/translation) and Written Opinion (no translation) issued in application No. PCT/DE2015/100146, dated Jun. 25, 2015 (12 pgs).
(Continued)

*Primary Examiner* — Neil Abrams
(74) *Attorney, Agent, or Firm* — Hayes Soloway P.C.

(57) ABSTRACT

Provided is a cable outlet for mounting on a cable outlet connection part of a device, housing or plug-in connector. A curable polymer which mechanically connects the cable outlet, the plug-in connector and a cable to be introduced is provided on the inner side of the cable outlet. The curable polymer may be disposed in a groove and may be covered by a protective film which is to be destroyed during assembly of the cable to the outlet.

10 Claims, 4 Drawing Sheets

(51) Int. Cl.
*H01R 13/52* (2006.01)
*H01R 43/00* (2006.01)

(58) Field of Classification Search
USPC ..... 439/521, 523, 936, 204, 587, 589
See application file for complete search history.

(56) References Cited

U.S. PATENT DOCUMENTS 3,755,615 A * 8/1973 Paullus ..... H01R 13/5205 174/76
3,999,830 A * 12/1976 Herrmann, Jr. ..... H01R 13/518 439/204
4,083,902 A * 4/1978 Clyde ..... H01R 13/5216 174/76
4,583,804 A * 4/1986 Thompson ..... H01R 13/516 439/470
4,875,870 A * 10/1989 Hardy ..... H01R 13/5216 174/76
4,998,894 A * 3/1991 Gronvall ..... G02B 6/4447 439/133
5,340,332 A * 8/1994 Nakajima ..... H01R 13/5205 439/583
5,397,859 A * 3/1995 Robertson ..... H01R 4/70 174/84 R
RE37,340 E * 8/2001 King, Jr. ..... H01R 4/22 174/87
6,500,027 B1 * 12/2002 Van Der Sanden ..... H01R 13/5216 439/587
7,153,150 B2 * 12/2006 Atsumi ..... H01R 13/5216 439/204
7,253,362 B1 8/2007 Dower et al. ..... 174/84 R
7,331,820 B2 * 2/2008 Burris ..... H01R 9/05 439/275
9,461,397 B2 * 10/2016 Feldmeier ..... H01R 13/5216
2004/0161968 A1 8/2004 Cawood et al. ..... 439/521
2007/0066134 A1 3/2007 Burris et al. ..... 439/578
2009/0014212 A1 1/2009 Malak ..... 174/75 C
2013/0118803 A1 5/2013 Magno, Jr. ..... 174/177 R
2015/0004814 A1 1/2015 Feldmeier ..... 439/89
2017/0025788 A1 * 1/2017 Lindkamp ..... H01R 13/5205

OTHER PUBLICATIONS

German Office Action issued in application No. 10 2014 105 442.3, dated Feb. 6, 2015 (5 pgs).
Written Opinion and International Preliminary Report on Patentability (English translation) issued in application No. PCT/DE2015/100146, dated Oct. 27, 2016 (8 pgs).

* cited by examiner

CABLE OUTLET WITH CURABLE POLYMER

BACKGROUND OF THE INVENTION

The invention is directed to a cable outlet for fixing a cable to a plug-and-socket connector.

Cable outlets of this kind are required in order to fix, mechanically attach, and mechanically stabilize cables which are routed away from devices, housings, or plug-and-socket connectors. Cable outlets which provide for a mechanical stabilization of the cable are also referred to as antikink devices.

In this case, cable outlets of this kind enclose the cable and are attached to a cable outlet connecting piece. The cable outlet connecting piece is integrally formed on the housing, the device, or the plug-and-socket connector, into which the cable is introduced. In the prior art, cable outlet connecting pieces of this kind usually comprise a thread, which is usually designed as an external thread.

A cable outlet having a corresponding thread is screwed onto the thread. During the screwing-down process, a clamping sleeve or a clamping element provided in the cable outlet is usually mechanically deformed or pressed radially inward, whereby the cable is mechanically fixed inside the cable outlet.

A disadvantage of this type of cable outlet is that they are protected only to a limited extent against contamination and penetration by moisture. In addition, the introduced cable is exposed to a very high mechanical load. If the cable outlet is screwed down too tightly, the cable can become damaged.

In addition, this type of cable outlet is not protected against manipulation and can be unscrewed and screwed back on any number of times. The user is unable to determine whether the connection has already been opened and, possibly, manipulated.

Another known type of cable outlets are cable outlets which are encapsulated directly in production. In this case, the cable and the cable outlet connecting piece are mechanically encapsulated. This is a highly advantageous type of cable outlets, since they can be utilized simultaneously as antikink devices.

One disadvantage of encapsulated cable outlets, however, is that they must be produced in a production environment using appropriate machines. On-site fabrication without machines or corresponding equipment is not possible.

The problem addressed by the invention is that of providing a cable outlet which is consistent with the advantages of the solutions already known from the prior art. The cable outlet should be capable of being fabricated on-site, should not require any special tools or machines in order to be produced, and must also be sealed against the environment, must be easy to handle, and must be safe from manipulation and unauthorized opening, and must be capable of accommodating a large bandwidth of cables having different thicknesses.

SUMMARY OF THE INVENTION

The invention relates to a cable outlet which is formed from a sleeve-shaped body. The body can consist of one part or multiple sub-segments. In an embodiment comprising multiple sub-segments, it is advantageous to design these to be hermaphroditic. In this way, only one type of parts needs to be stockpiled.

The body is intended to be plugged into or screwed onto a cable outlet connecting piece. In this case, the cable outlet connecting piece is provided on a housing, a device, or a plug-and-socket connector, away from which a cable is intended to be routed. The cable outlet connecting piece advantageously encloses the outwardly extending cable in this case.

The cable outlet connecting piece can be designed round or angular. The cable outlet must be designed according to the design of the cable outlet connecting piece. In this case, either the entire body of the cable outlet can have the shape of the cable outlet connecting piece, or only the inside of the cable outlet can be correspondingly designed, in order to ensure an integral bond between the cable outlet and a cable outlet connecting piece.

According to the invention, a curable polymer is provided on the inside of the body of the cable outlet. Different types of curable polymers are conceivable. Polymers containing a solvent, which volatizes via evaporation and thereby solidifies the polymer, are conceivable, as are two-component polymers which cure when mixed. Polymers which cure under the action of light or temperature can also be used.

The curable polymer provided on the inside of the body is applied directly or is provided with a thin protective film, depending on the type of polymer. The protective film can have different design. Either a protective film, which must be removed before the cable outlet is installed, or a thin protective film, which is destroyed when the cable outlet is installed on a cable outlet connecting piece and, as a result, the curing of the polymer is initiated.

Advantageously, the curable polymer is provided on the inside of the body in such a way that it is connected to the body, the cable routed therethrough, and the cable outlet connecting piece after the cable outlet is installed. It is thereby ensured that a secure, tight connection between the components is established.

The connection of the body, the cable, and the cable outlet connecting piece by means of the cured polymer therefore ensures that the cable is mechanically fixed on the cable outlet connecting piece and provides protection against penetration by environmental influences such as moisture and dust. Given that a flexible material is used as the body, the flexibility of the cable connection is retained nonetheless and the cable outlet functions simultaneously as an antikink device.

In one particularly advantageous embodiment, the curable polymer is provided in a groove extending around the periphery of the inside of the body. As a result, the polymer is retained and, after the polymer cures, a pull-resistant connection between the polymer and the body is ensured.

The invention is particularly advantageous due to its easy handling, which makes it possible to also fabricate the cable outlet on-site.

The cable is simply introduced into the cable outlet connecting piece of a device, a housing, or a plug-and-socket connector and is then connected. The cable outlet can be positioned on the cable either before the cable is connected, in the case of a one-part body, or after the cable is connected, in the case of a multi-part body. When the cable outlet is slid onto the cable outlet connecting piece, the curable polymer is distributed in the interior space of the body and is connected to the body, the cable, and the cable outlet connecting piece. Once the polymer cures, the cable outlet is fully assembled.

Depending on the polymer that is used, a protective film either also must be removed from the polymer before the cable outlet is slid onto the cable outlet connecting piece. In one preferred embodiment, the protective film is destroyed or at least torn open by the cable outlet being slid onto the cable outlet connecting piece, whereby the polymer can become distributed in the body.

In another embodiment, the curable polymer also has an adhesive property in order to provide for an improved connection between the cable outlet connecting piece, the cable outlet, and the cable.

BRIEF DESCRIPTION OF THE DRAWINGS

One exemplary embodiment of the invention is represented in the drawings and is described in greater detail in the following. In the drawings.

The figures comprise partially simplified, schematic representations. Identical reference numbers are used, in part, for parts that are similar but may not be identical. Different views of similar elements could be scaled differently.

DETAILED DESCRIPTION OF THE INVENTION

Figure 1:
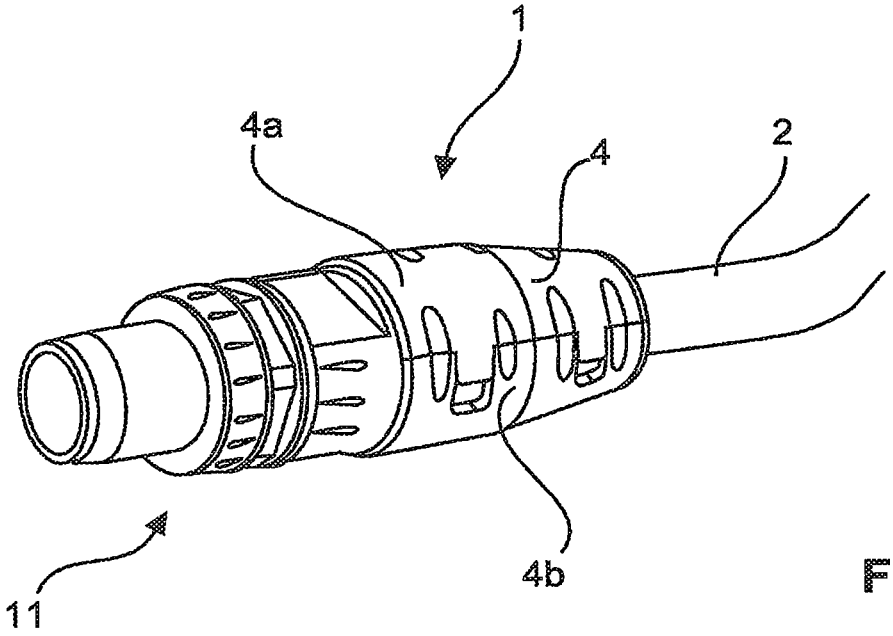
FIG. 1 shows a perspective representation of a cable outlet on a plug-and-socket connector.

FIG. 1 shows a perspective representation of a cable outlet 1 on a plug-and-socket connector 11. The cable outlet 1 consists of two hermaphroditic half shells 4*a*/4*b* of the same kind, which, together, form a body 4. In this example, the plug-and-socket connector 11 is designed as a round plug-and-socket connector.

A cable 2 is introduced into the cable outlet 1 from the back side of the body 4, which cable outlet is connected in the plug-and-socket connector 11. The front side of the body 4 has been inserted onto the plug-and-socket connector 11.

Figure 2:
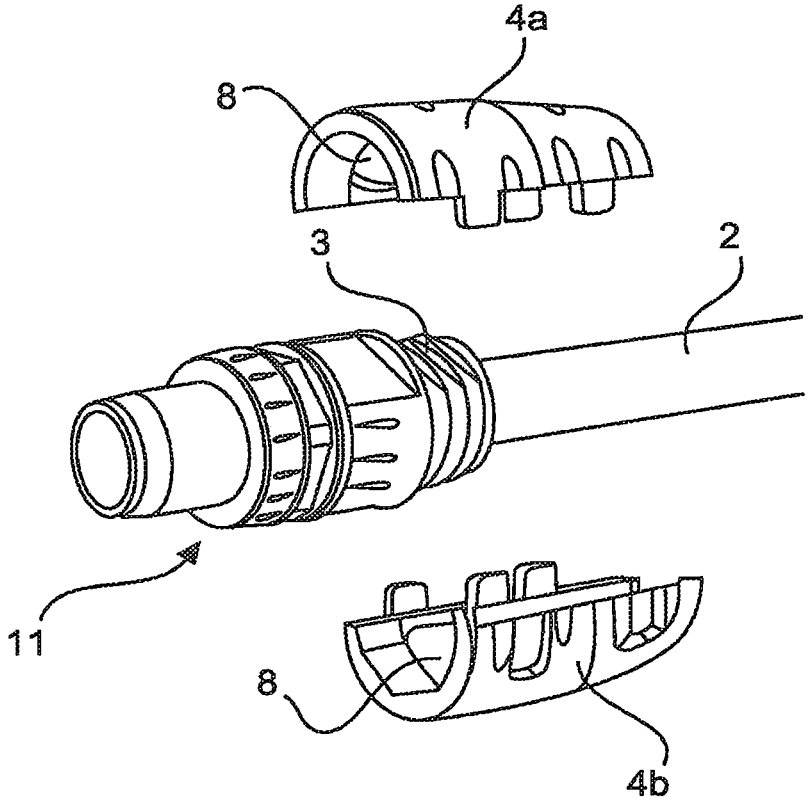
FIG. 2 shows a perspective, exploded view of the cable outlet from FIG. 1.

In FIG. 2, the cable outlet from FIG. 1 is shown in a perspective, exploded representation. In this case, the two half shells 4*a*/4*b* are shown pulled apart from one another. A cable outlet connecting piece 3 of the plug-and-socket connector 3 is apparent here, on which cable outlet connecting piece the half shells 4*a*/4*b* of the cable outlet 1 are retained.

The cable 2, which is connected to the plug-and-socket connector 1 on the back side, has been introduced into the cable outlet connecting piece 3 of the plug-and-socket connector 1. A curable polymer 8 is evident on the inside of the half shells 4*a*/4*b*, which polymer is intended to be distributed around the cable outlet connecting piece 3 and the cable 3. When the half shells 4*a*/4*b* are assembled to form a body 4 (FIG. 1), the curable polymer 8 fills the open space between the cable outlet connecting piece 3, the cable 2, and the body 4 in a form-fitting manner.

The curing of the polymer 8 after assembly results in a mechanical fixation between the cable outlet 1, the cable outlet connecting piece 3, and the cable 2. Advantageously, the curable polymer 8 is provided in the body 4 in such a way that it is applied in the region of the rear end of the cable outlet connecting piece 3.

Figure 3:
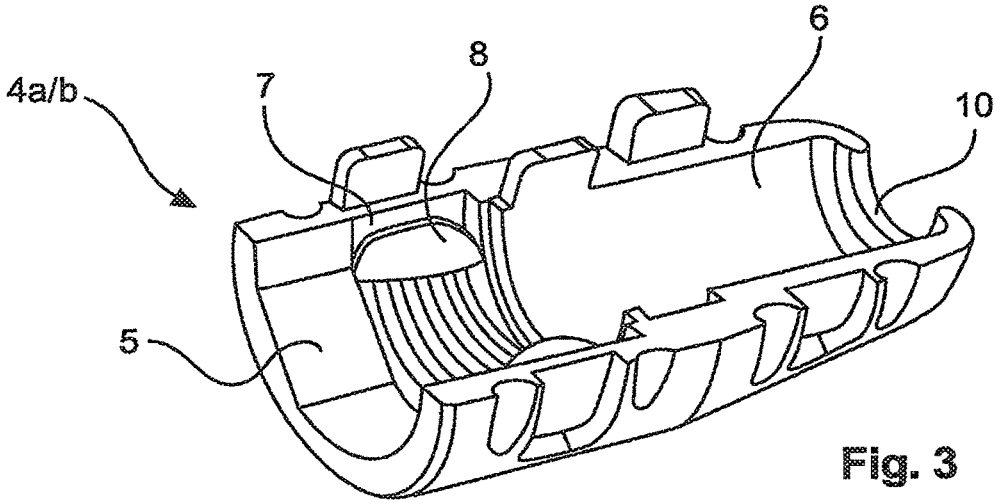
FIG. 3 shows a perspective representation of a half shell of a body of the cable outlet.

FIG. 3 shows a perspective representation of one half shell 4*a/b* of a body 4 of the cable outlet 1. In the front region, shown on the left, the half shell 4*a/b* has a form-fit opening 5 which is adapted to the cable outlet connecting piece 3. The cable outlet 1 is thereby prevented from being rotated on the cable outlet connecting piece 3.

In one advantageous embodiment, the form-fit opening 5 can also be designed as a thread which can be screwed onto the cable outlet connecting piece 3.

The central region of the half shell 4*a/b* is designed as a cable guide 6 and is used for guiding a cable 2 in the cable outlet 1. A cable inlet opening 10 is integrally formed on the back side—shown on the right here—of the half shell 4*a/b*. This taper is used for sealing the interior of the cable outlet 1, with respect to the environment, in the region of the cable introduction. Depending on the type of material used for the half shell 4*a/b*, this region or the entire half shell 4*a/b* can be formed from flexible material.

In the region between the form-fit opening 5 and the cable guide 6, a groove 7 is formed in the inside of the half shell 4*a/b*, which groove is provided for accommodating the curable polymer 8. The groove 7 is advantageously disposed in such a way that is covered, in the installed state, by the cable outlet connecting piece 3. As a result, the cable outlet connecting piece 3 which is guided into the cable outlet 1, displaces the curable polymer 8 and distributes said polymer in the interior of the cable outlet 1.

Figure 4:
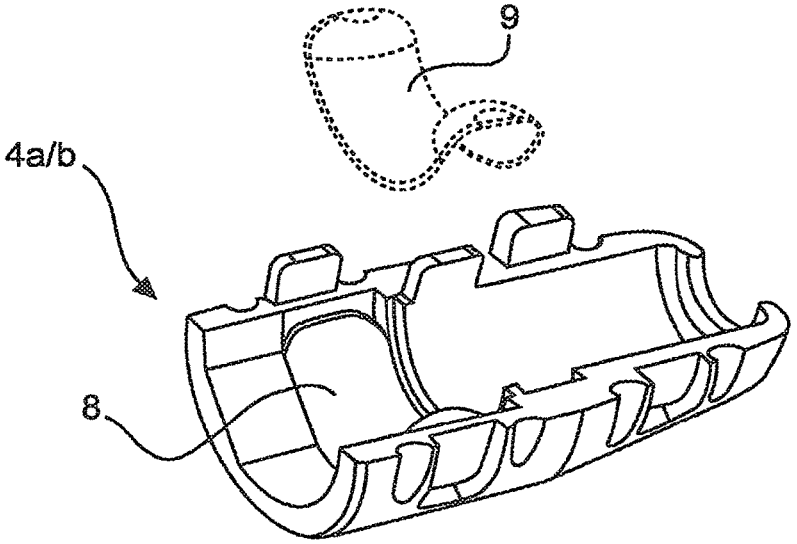
FIG. 4 also shows a perspective representation of a half shell of a body of the cable outlet.

The half shell 4*a/b* from FIG. 3 is shown again in FIG. 4, although with a protective film 9, which is shown removed from the half shell 4*a/b*. The protective film 9 is provided for sealing the curable polymer 8 so that said polymer does not cure before assembly. In this case, the protective film 9 can be a removable element which must be removed from a cable outlet connecting piece 3 before the cable outlet 1 is assembled.

According to one advantageous embodiment of the protective film 9, said protective film must be designed very thin, so that the protective film 9 is destroyed when the cable outlet 1 is installed on a cable outlet connecting piece 3 and the curable polymer 8 can become distributed in the cable outlet 1.

Figure 5:
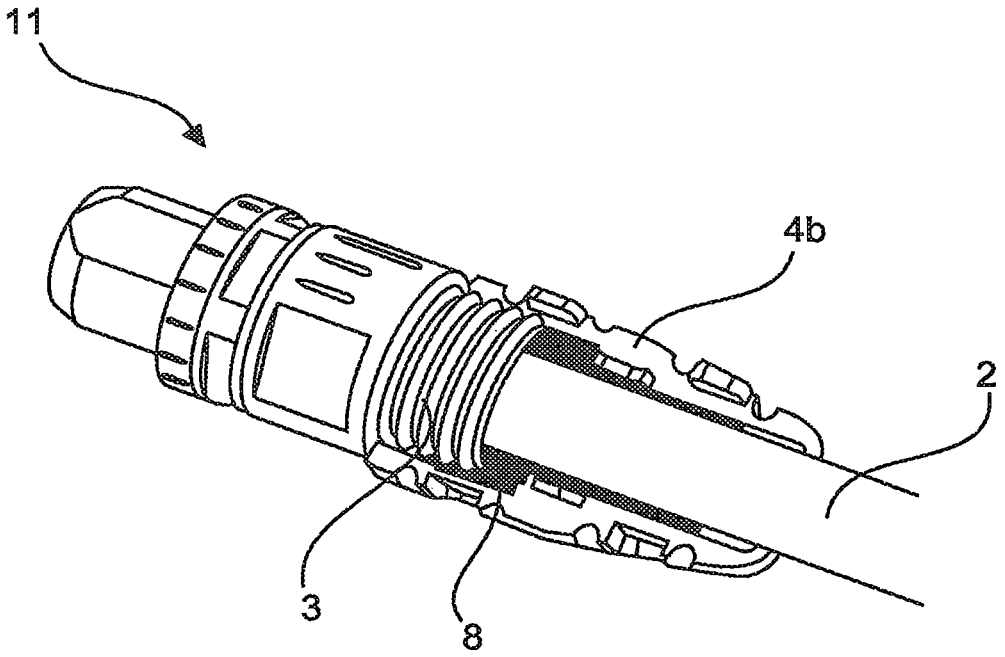
FIG. 5 shows a perspective representation of a partially opened cable outlet according to FIG. 1.

The cable outlet 1 from FIG. 1 is shown again in FIG. 5, in a partially opened representation, wherein one half shell 4*a* is not shown, in order to allow for a view into the interior of the cable outlet 1. It is apparent that the cable outlet connecting piece 3 has penetrated the curable polymer 8 and has displaced it.

As a result, the curable polymer 8 has become distributed from its original position in the groove 7 (see FIG. 3 and FIG. 4) in the entire interior space of the cable outlet 1. The curable polymer 8 is thus displaced from the form-fit opening 5 up to the cable guide 6 and has surrounded the cable 2.

Figure 6:
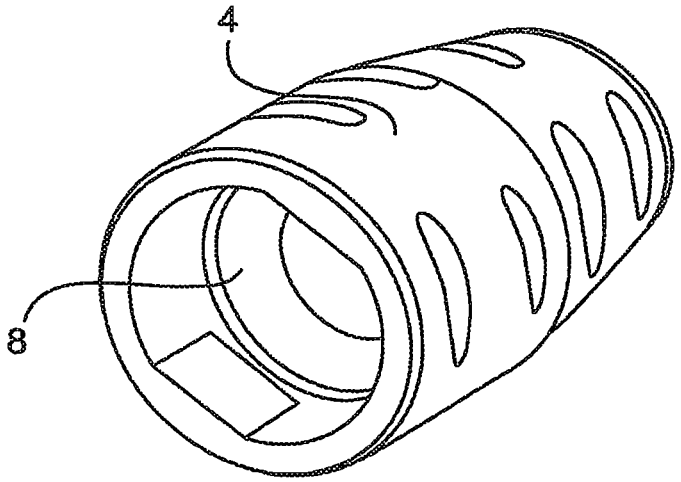
FIG. 6 shows a perspective representation of a further cable outlet.

A further cable outlet 1 is represented in FIG. 6. In this embodiment, the body 4 is designed as one part. In this case as well, the curable polymer 8 is provided on the inside of the body 4, in a groove 7. In contrast to the embodiment from FIGS. 1 to 5, in this case, the cable outlet 1 must be placed onto the cable 2 before assembly, before the cable 2 is introduced into the cable outlet connecting piece 3. The two-part design of the body 4 from FIGS. 1 to 5 makes it possible to also install the cable outlet 1 after the cable 2 has been installed.

Figure 7:
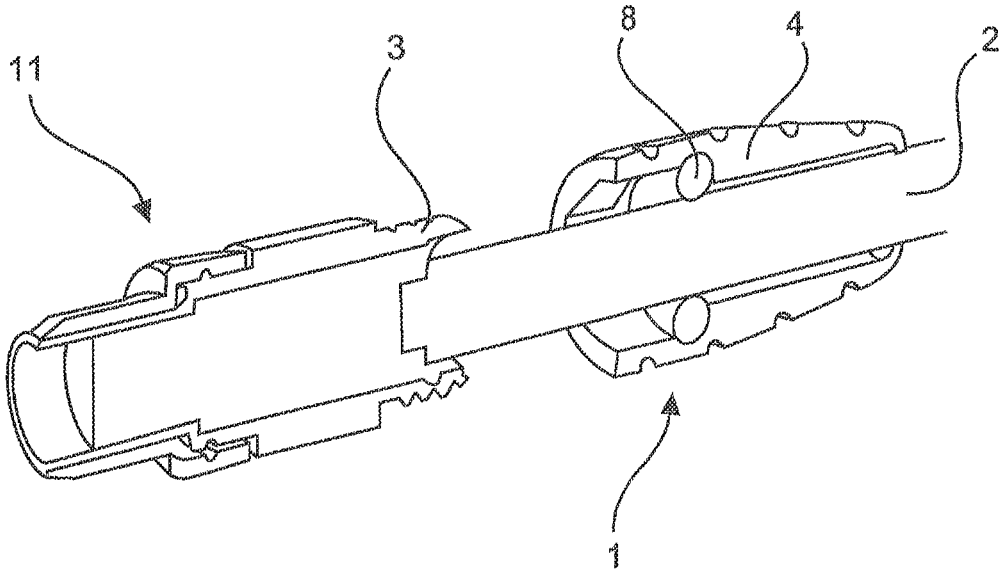
FIG. 7 shows a perspective part section of the cable outlet from FIG. 6 before the final installation on a plug-and-socket connector.

The cable outlet 1 from FIG. 6 is shown in a sectional view in FIG. 7 in the partially installed state. A section through the plug-and-socket connector 11 and its cable outlet connecting piece 3, into which the cable 2 has been introduced, is represented. The cable outlet 1 has already been placed onto the cable 2, but has not yet been pressed onto the cable outlet connecting piece 3.

The curable polymer 8 is provided in the shape of a ring on the inside of the body 4, in the groove 7, wherein the cable 2 is not yet in contact with the curable polymer 8.

Figure 8:
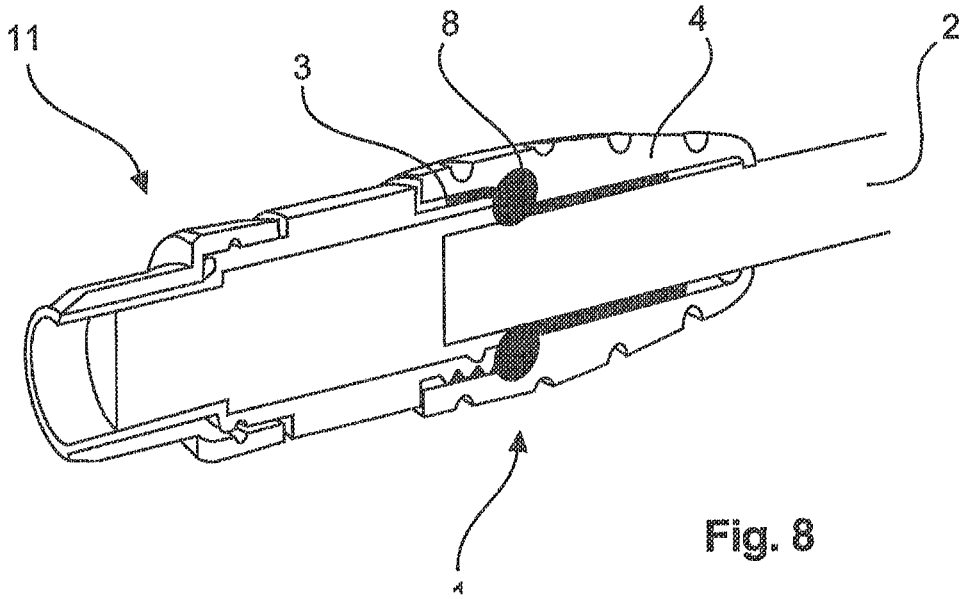
FIG. 8 shows a perspective part section of the cable outlet from FIG. 6 in the finally installed state.

FIG. 8 shows the fully assembled cable outlet 1 on the cable outlet connecting piece 3 of the plug-and-socket connector 11, also in a sectional view. The penetration by the cable outlet connecting piece 3 into the curable polymer 8 has destroyed the protective film on the curable polymer 8 and has distributed the curable polymer 8 into the intermediate spaces between the cable outlet connecting piece 3, the body 4, and the cable 2.

More or less curable polymer 8 extends into the intermediate space, depending on the thickness of the introduced cable 2. As a result, the cable outlet 1 according to the invention can be used in a highly flexible manner for different cable thicknesses. The thicker the cable 2 is, the more material can extend into the intermediate space of the cable guide 6. When a thin cable 2 is introduced, the curable polymer 8 is sufficient for establishing a connection between the cable outlet connecting piece 3, the body 4, and the cable 2 without a great deal of material being pressed into the cable guide 6.

LIST OF REFERENCE NUMBERS

1 Cable outlet
2 Cable
3 Cable outlet connecting piece
4 Body
5 Form-fit opening
6 Cable guide
7 Groove
8 Curable polymer
9 Protective film
10 Cable inlet opening
11 Plug-and-socket connector

The invention claimed is:

1. A cable outlet for fixing a cable to a plug-and-socket connector, said cable outlet including a cable outlet connecting piece and a sleeve-shaped body, said sleeve-shaped body having a form-fit opening adapted to accommodate and hold the cable outlet piece against rotation, wherein a curable polymer is provided on an interior of the sleeve-shaped body, and a groove is provided on the inside of the body and covered with a protective film, and the curable polymer is disposed in the groove.

2. The cable outlet as claimed in claim 1, wherein the protective film comprises a thin-walled material which is susceptible to being acted upon mechanically.

3. The cable outlet as claimed in claim 1, wherein the sleeve-shaped body comprises multiple sub-segments.

4. The cable outlet as claimed in claim 3, wherein the sleeve-shaped body comprises two half shells.

5. The cable outlet as claimed in claim 4, wherein the half shells of the body are hermaphroditic.

6. The cable outlet as claimed in claim 1, wherein the curable polymer is self-curing upon contact with ambient air.

7. A cable outlet for fixing a cable to a plug-and-socket connector, said cable outlet including a cable outlet connecting piece and a sleeve-shaped body which comprises two half shells, wherein a curable polymer covered with a protective film is provided on the inside of the sleeve-shaped body, and a groove is provided on the inside of the body and the curable polymer is disposed in the groove.

8. The cable outlet as claimed in claim 7, wherein the protective film comprises a thin-walled material which is susceptible to being acted upon mechanically.

9. The cable outlet as claimed in claim 7, wherein the half shells of the body are hermaphroditic.

10. The cable outlet as claimed in claim 7, wherein the curable polymer is self-curing upon contact with ambient air.

* * * * *